United States Patent [19]

Hosoya et al.

[11] 4,430,404

[45] Feb. 7, 1984

[54] ELECTROPHOTOGRAPHIC PHOTOSENSITIVE MATERIAL HAVING THIN AMORPHOUS SILICON PROTECTIVE LAYER

[75] Inventors: Akira Hosoya; Kunihiro Tamahashi; Shigeharu Onuma, all of Hitachi; Atsushi Kakuta, Hitachiota; Yasuki Mori, Hitachi; Katsuhito Suzuki, Mito; Hirosada Morishita, Hitachi, all of Japan

[73] Assignees: Hitachi, Ltd.; Hitachi Koki Co., Ltd., both of Tokyo, Japan

[21] Appl. No.: 371,956

[22] Filed: Apr. 26, 1982

[30] Foreign Application Priority Data

Apr. 30, 1981 [JP] Japan ..... 56-64182
May 8, 1981 [JP] Japan ..... 56-68141

[51] Int. Cl.[3] ..... G03G 5/14

[52] U.S. Cl. ..... 430/58; 430/66; 430/67; 430/961

[58] Field of Search ..... 430/57, 66, 67, 69, 430/58, 961

[56] References Cited

U.S. PATENT DOCUMENTS

| | | | |
|---|---|---|---|
| 3,904,406 | 9/1975 | Takahashi | 430/67 |
| 4,084,986 | 4/1978 | Aoki et al. | 148/1.5 |
| 4,225,222 | 9/1980 | Kempter | 427/39 |

FOREIGN PATENT DOCUMENTS

| | | | |
|---|---|---|---|
| 54-127561 | 3/1979 | Japan | 430/57 |
| 55-87155 | 1/1980 | Japan . | |

*Primary Examiner*—John D. Welsh
*Attorney, Agent, or Firm*—Antonelli, Terry & Wands

[57] ABSTRACT

An electrophotographic photosensitive material having a long lifetime can be provided by forming an amorphous silicon layer having a thickness of 0.01–0.08 μm on the photoconductive layer on the electrically conductive substrate in the said material without changing the characteristics of the photoconductive layer.

13 Claims, 7 Drawing Figures

ELECTROPHOTOGRAPHIC PHOTOSENSITIVE MATERIAL HAVING THIN AMORPHOUS SILICON PROTECTIVE LAYER

BACKGROUND OF THE INVENTION

1. Field of the Invention

This invention relates to an electrophotographic photosensitive material having a photoconductive layer on an electrically conductive substrate, as well as to a process for producing said electrophotographic photosensitive material.

2. Description of the Prior Art

As electrophotographic photosensitive materials, there are generally employed photosensitive materials consisting of an electrically conductive substrate such as aluminum, iron, their alloys or the like having thereon an inorganic photoconductive layer consisting of amorphous selenium, Se-Te alloy or In-sensitized amorphous selenium or Se-Te alloy, or an organic photoconductive layer. Usually, this type of photosensitive material is used in a process for the formation of an image comprising subjecting the surface of a photosensitive material to charging, image exposure and development by the Karison process on its surface, and optionally transferring the toner image formed by the development onto paper or the like.

In such a process, the photoconductive film is mechanically injured in the step of transferring the developed toner image to paper or the like or in the step of removing the toner remaining on the surface of photosensitive material by means of a brush or the like. However, because of the low hardness of the selenium constituting the photoconductive film, scuff marks are formed on the surface of photoconductive layer every time these steps are repeated. As a result, crystallization of selenium takes place at the part of scuff marks to make the charging difficult, so that the difference of potential necessary for electrophotography becomes impossible to obtain and the print becomes indistinct.

In Japanese Patent Application Kokai (Laid-Open) No. 87,155/80, there is proposed a photosensitive material provided with a photoconductive amorphous silicon layer for improving the abrasion resistance of photoconductive material such as CdS, ZnO, Cd-Te or the like. In U.S. Pat. No. 4,225,222 there is mentioned a technique for forming a layer of amorphous silicon having hydrogen on the surface of a drum. All these known techniques are grounded on the utilization of amorphpus silicon as a photoconductive layer. However, amorphous silicon is so poor in film-formability that about one day is necessary for forming a photoconductive amorphous silicon by a chemical decomposition-deposition process (CVD process) or a sputtering process. Further, amorphous silicon is low in sensitivity to rays having a long wave length such as semiconductor laser ray, though it is high in sensitivity to He-Ne gas laser or He-Ce laser ray, both of which have a short wave length.

SUMMARY OF THE INVENTION

It is an object of this invention to provide an electrophotographic photosensitive material which is improved in abrasion resistance of the surface of photosensitive material without changing the characteristics of photoconductive layer, has a prolonged lifetime in the repeated use in electrophotographic printing and is capable of increasing the number of printable sheets.

In this invention, the above-mentioned object has been achieved by providing a thin layer of amorphous silicon having substantially no ability to absorb light to be irradiated on the inorganic or organic photoconductive layer or a combination thereof of an electrophotographic photosensitive material consisting of an electrically conductive substrate having thereon the said photoconductive layer.

The present inventors have found that, if the very thin amorphous silicon layer has no light-absorbing ability and does not function as a photoconductive material, the photosensitive material can be saved from decrease in sensitivity, and a high sensitivity and a high abrasion resistance can be realized simultaneously.

Other objects and characteristic features of this invention will become apparent from the detailed description of the invention referring to the accompanying drawings.

and

Figure 4:
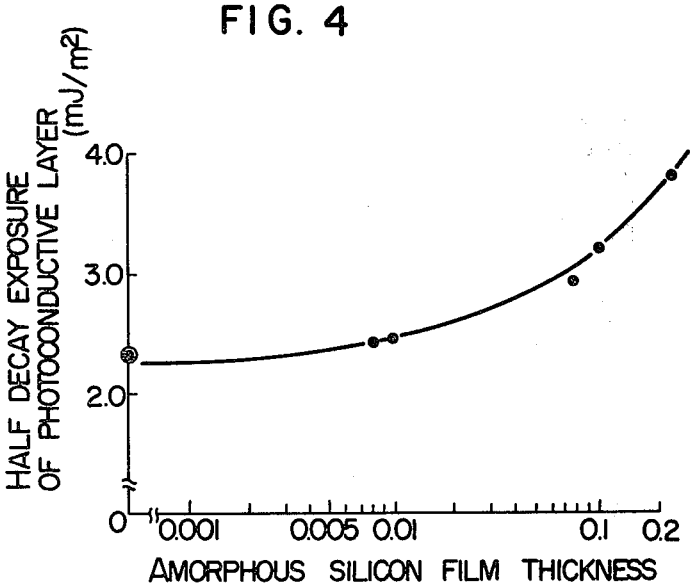
Figure 5:
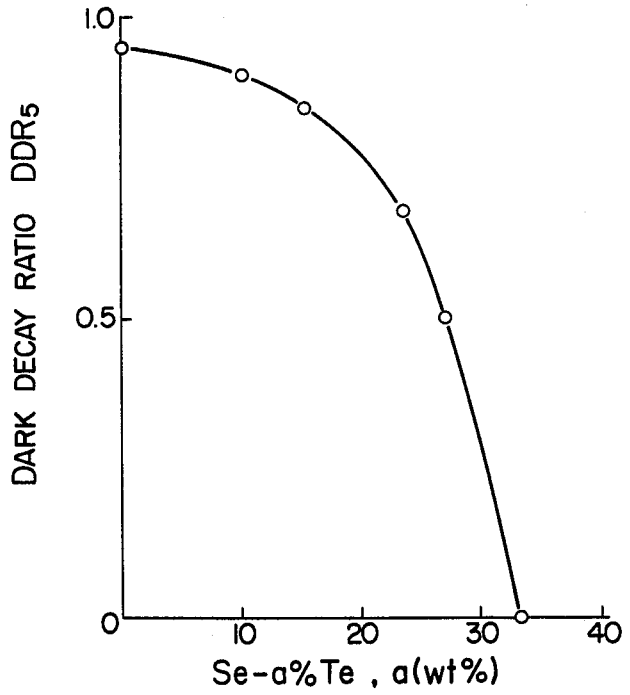
Figure 6:
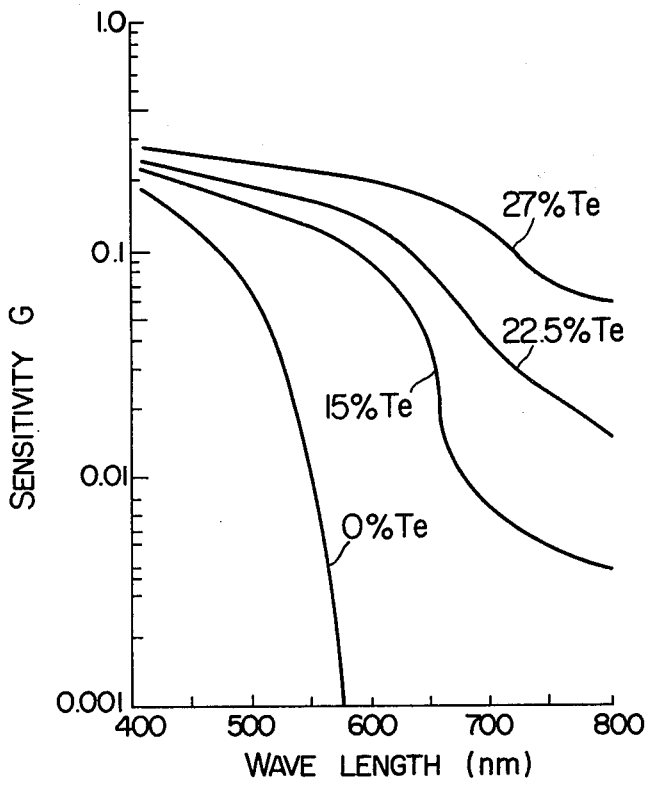
Figure 7:
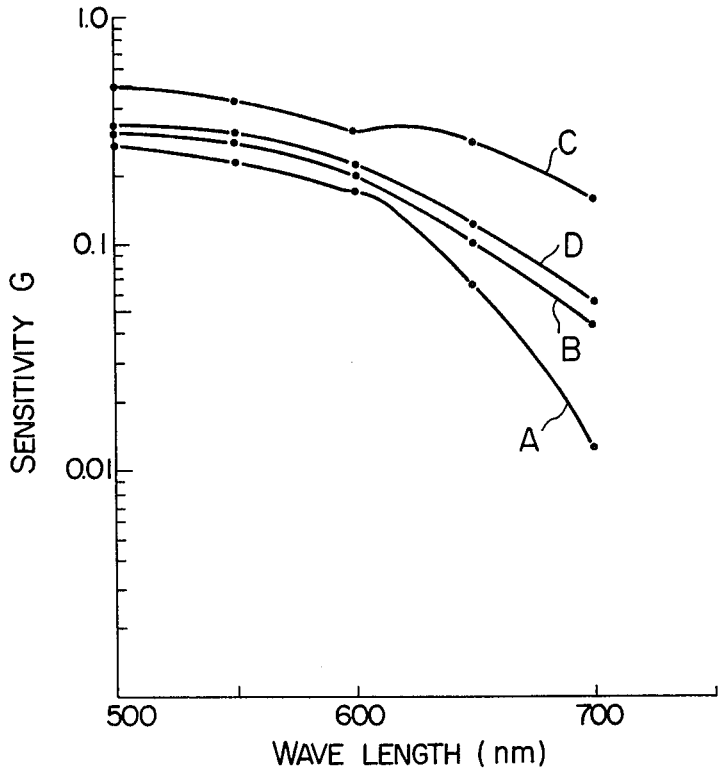

FIG. 4 is a graph indicating the relation between thickness of amorphous silicon film and half decay exposure;

FIG. 5 is a graph indicating the relation between the amount of Te in Se-Te alloy and half decay exposure;

FIG. 6 is a graph indicating the relation between the amount of Te in the sensitizing Se-Te layer and the spectrometric sensitivity; and FIG. 7 is a graph indicating the relation between the amount of In in the sensitizing Se-Te layer and the spectrometric sensitivity.

DETAILED DESCRIPTION OF THE INVENTION

Figure 1:
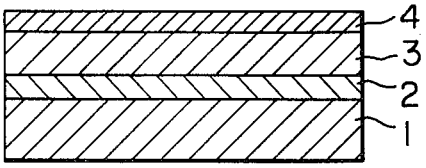
FIG. 1 and FIG. 2 are cross-sectional views of photosensitive materials indicating examples of this invention.

FIG. 1 is a cross-sectional view of photosensitive material indicating one example of this invention, wherein 1 is an electrically conductive substrate, 2 is a layer of arsenic triselenide, 3 is a layer of amorphous selenium and 4 is a layer of amorphous silicon.

The electrically conductive substrate 1 is a plate of metal such as aluminum, copper, lead, iron or the like, or it may also be a plate of metal oxide such as $SnO_2$, $In_2O_3$, $CrO_2$, CuI or the like, or it may also be a plastic film, the surface of which is coated with a metal or a metal oxide by a vapor-deposition or sputtering method.

The arsenic triselenide layer 2 is a barrier layer, and the amorphous selenium layer 3 is a photoconductive layer.

Figure 2:
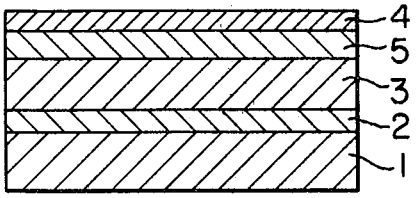

FIG. 2 is a cross-sectional view of an electrophotographic photosensitive material indicating another example of this invention. In FIG. 2, 1–4 are the same constituents as in FIG. 1, except that a selenium-tellurium alloy layer 5 is formed on the amorphous selenium layer 3. That is, since the photoconductive layer consisting of amorphous selenium has no sensitive region in the long wave length side, it is also possible to sensitize it by forming a layer of selenium-tellurium alloy over the amorphous selenium layer, and in such a type of photosensitive material it is similarly possible to provide an amorphous silicon layer. Further, the inorganic photoconductive layer of this invention also includes a cadmium-doped selenium layer for the purpose of sensitization in addition to the above.

The thin amorphous silicon layer functioning as a surface protecting layer can be formed by a known process such as a vapor deposition process, a glow discharge process, a sputtering process or the like while keeping the selenium-based photosensitive material and the substrate at a temperature not higher than the normal temperature. A barrier layer, such as an arsenic triselenide layer should be placed depending upon the properties required for photosensitive material, so that it is not always necessary.

EXPERIMENTAL EXAMPLE

As the material used for vapor deposition, there were used selenium and arsenic triselenide, both having a high purity of 99.99% or more. As the material for forming amorphous silicon film, monosilane ($SiH_4$) was used. The vapor deposition of arsenic triselenide and amorphous selenium was carried out by the use of Mandrel vacuum deposition apparatus equipped with a base plate-rotating means and a heating-cooling means. Thus, under a pressure of $5\times10^{-5}$ Torr, a boat containing the material was heated to the predetermined temperature (i.e. 500°–600° C. in the case of arsenic triselenide and 260° C. in the case of amorphous selenium) and the material was deposited on the rotating base plate. The revolution speed of the base plate was 10–30 r.p.m., and the base plate was heated to 60°–70° C. at the time of vapor deposition.

After the vapor deposition, cold water having a temperature −20° C. was poured to cool the base plate rapidly. Then, after confirming that the temperature of the base plate had reached 30° C., a gas of monosilane ($SiH_4$) was introduced, and an amorphous silicon film was formed by glow discharge to obtain a photoconductor having a structure shown in FIG. 1. The thickness of the arsenic triselenide was adjusted to 0.1–1.0 μm or less, over which a layer of amorphous selenium having a thickness of 58–60 μm was deposited. Thereafter, amorphous silicon having a film thickness shown in the following table was deposited by the process of glow discharge.

TABLE

| Sample No. | Thickness of amorphous silicon film (μm) |
|---|---|
| 1 | 0.005 |
| 2 | 0.01 |
| 3 | 0.05 |
| 4 | 0.08 |
| 5 | 0.1 |

Surface dent hardnesses of the photosensitive materials shown in the Table were measured by the pencil hardness test which is generally employed for evaluating the hardness of electrophotographic photoconductive films. The measurement was carried out by holding a pencil having a flattened lead (the hardness of the lead was varied) at an angle of 60° to the surface of photosensitive material (surface of amorphous silicon film), applying a force so as to push forward the pencil and determining the hardness of pencil lead necessary for yielding a dent concave relative to the film surface. The hardness thus determined was taken as dent hardness. The results of the measurement are summarized in FIG. 3.

Figure 3:
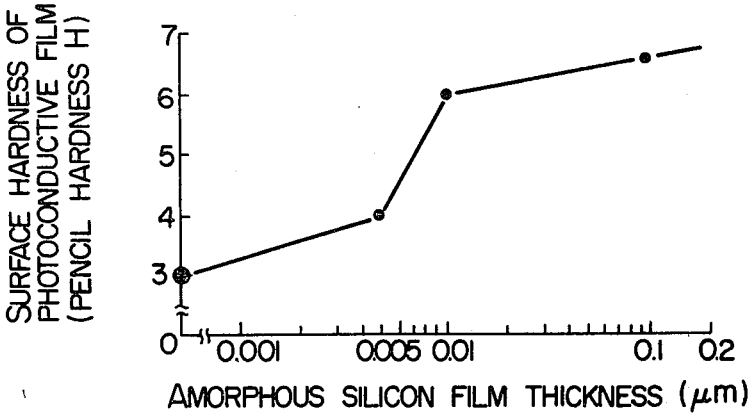
FIG. 3 is a graph indicating the relation between thickness of amorphous silicon film and its surface hardness.

As is apparent from FIG. 3, the dent hardness of the photosensitive material having thereon the amorphous silicon film having a thickness of 0.005 μm in the Table is not significantly higher than that of the hitherto known amorphous selenium film (having no amorphous silicon film). However, the amorphous silicon films having a thickness of 0.01 μm or more in the Table show a hardness twice or more that of hitherto known products.

On the other hand, among the electrophotograph characteristics, the half decay exposure of photoconductive layer necessary for giving a sharp typing image is 3.0 mJ/m² or less. In FIG. 4 representing the relation between thickness of amorphous silicon film and half decay exposure, the half decay exposure of photoconductive layer at a wave length of 430 nm is 3.20 mJ/m² when the thickness of amorphous silicon is 0.1 μm, and the half decay exposure tends to increase with an increase in thickness of the film. It is also found that a half decay exposure of about 3.0 mJ/m² is given by an amorphous silicon film having a thickness of 0.08 μm. Accordingly, the optimum range of the thickness of amorphous silicon film is 0.01–0.08 μm.

Furthermore, a printing resistance test was carried out by using the drums of sample Nos. 1–5. As a comparative example, a photosensitive material having an amorphous selenium layer and a selenium-tellurium-antimony alloy layer successively superposed on an electrically conductive substrate plate (Sample No. A) was used. As a result of a printing resistance test, paper scuff marks appeared on the surface of drum in Sample No. A and Sample No. 1 when about 200,000 sheets of paper had been printed and thereafter the drum became unusable. In Sample Nos. 2 to 4, 1,000,000 sheets could be printed with good quality of typing image.

The results of tests mentioned above are those for the photosensitive material shown in FIG. 1, and the same results as above can also be obtained from the photosensitive material shown in FIG. 2.

The amorphous silicon layer of this invention functions substantially as an abrasion-proofing protector for the photoconductive layer and, simultaneously, it has a small thickness to such an extent that it exhibits no ability of light absorption and therefore does not substantially change the photosensitive characteristics of the photoconductive layer.

As above, according to this invention, the abrasion resistance of the surface of photosensitive material can be improved without lowering the electrophotographic characteristics, so that the lifetime of photosensitive material can be prolonged and the number of printable sheets can be increased.

Another example of this invention applied to FIG. 1 is as follows: There are formed a In-containing Se-Te type sensitizing layer 3, a carrier transportation layer 2 consisting of Se, and an amorphous silicon layer 4 on an electrically conductive support 1.

In this case, the amount of Te in Se-Te type sensitizing layer 3 is preferably about 15% by weight from the viewpoint of dark decay ratio (DDR). The preferable amount of Te can be determined from the relation between the amount of Te in Se-Te alloy and DDR shown in FIG. 5. The graph of FIG. 5 was obtained in the following manner:

Selenium was deposited in a thickness of 40 μm on an aluminum base plate at a base plate temperature of 62°

C. at a vacuum of $1\times10^{-5}$ Torr at a deposition rate of 1 μm/min, and subsequently Se-Te alloy was deposited in a thickness of 0.5 μm at a deposition rate of 0.1 μm/min, while varying the amount of Te in the Se-Te alloy in the range not exceeding 30%. Using a paper analyzer, a corona voltage of 5.5 KV was applied to the photosensitive materials thus obtained to produce an initial surface potential of 600 V. After alloying the materials to stand under the said conditions in the dark for 5 seconds, the decay of potential was measured. The dark decay ratio (DDR) was expressed by the quotient of the potential after 5 seconds by 600 V.

In order to produce a sharp typing image, however, the dark decay ratio usually has to satisfy the following relationship: $DDR_5 \geqq 0.8$. In FIG. 5, the change in dark decay ratio $DDR_5$ is relatively small and $DDR_5$ itself is greater than 0.8 so far as the amount of Te in Se-Te alloy is in the range of 0–15%. However, if the amount of Te in Se-Te alloy is too small, the photosensitivity decreases. Accordingly, the amount of Te is preferably about 15% by weight.

If the sensitivity G is defined as the reciprocal of the light energy necessary for reducing the surface potential to ½ of the initial value by exposure, the relation between sensitivity G of the above-mentioned photosensitive material and its Te content becomes as shown by the graph in FIG. 6. That is, at 632.8 nm, the sensitivity of 15% Te alloy is ¼ of that of 23% Te alloy.

In order to increase the sensitivity of the Se-15% Te system at 632.8 nm, the band gap ($E_g$) must be made smaller in view of the material characteristics, and the necessary value of $E_g$ is 1.0–1.5 eV. An $E_g$ value falling in this range can be obtained by adding an element having a smaller value of $E_g$, and a relation of the following equation (1) holds between $E_g$ and specific resistance $\rho$ of an alloy:

$$\frac{1}{\rho} = \frac{1}{\rho_o} \exp\left(-\frac{E_g}{2RT}\right) \quad (1)$$

wherein

R is the Boltzmann constant,

T is the absolute temperature, and $\rho_o$ is $\rho$ at an absolute temperature of 0° K. by extrapolation.

That is to say, there exists the lower limit of resistivity in the electrophotography wherein the surface of photosensitive material is statically charged to have a sensitivity, and a resistivity of $10^{10}$ to $10^{12}$ Ω·cm or more is necessary. If $E_g$ is 1.0–1.5 eV, the $\rho$ of Te-Se alloy comes to about $10^8$·cm, which is smaller than the lower limit of the necessary resistivity. Accordingly, making $E_g$ smaller is contradictory to making the $\rho$ greater. For this reason, in this invention, indium capable of forming a deposition type alloy with Te is added to the Se-Te type sensitizing layer 3. That is, indium having an $E_g$ value of 1.0–1.5 eV is dispersed in the matrix of a high resistivity Se-Te system, particularly that containing about 15% by weight of Te, for the purposes of retaining a high resistivity without lowering the sensitivity of the whole Se-Te sensitizing system 3.

The amount of indium added to the Se-Te type sensitizing layer 3 should be appropriately selected in consideration of sensitizing effect and sensitivity characteristics, and its preferable amount falls in the range mentioned below.

Thus, FIG. 7 indicates the change of spectrometric sensitivity as a function of the amount of indium added to the Se-Te type sensitizing layer containing 15% by weight of Te, wherein curves A, B, C, D and E correspond to 0%, 0.05%, 2.0% and 5.0% (all by weight) of indium added, respectively.

According to FIG. 7, the spectrometric sensitivity of the sensitizing layer B containing 0.5% by weight of indium is approximately equal to that of the sensitizing layer A, which means that no increasing effect of sensitization is observable there. As the amount of indium added increases to 0.1% by weight and further to 2.0% by weight, the effect of sensitization increases. However, the spectrometric sensitivity decreases on the contrary when the amount of indium reaches 5.0% by weight. A photosensitive material having a Se-Te type sensitizing layer containing 6% by weight of indium was prepared, and a corona voltage of 5.5 KV was applied to it. As a result, it was found that the charge potential was about 200 V, indicating a low sensitivity, and the product was unusable as a photosensitive material. Therefore, it is most desirable that the amount of In added to the Se-Te type sensitizing layer be about 0.1–5.0% by weight.

The same effect as above can be obtained even if the lamination order of the Se-Te type sensitizing layer 3 and the Se layer 2, which is the carrier transportation layer, is reversed. Further, the material usable as said carrier transportation layer is not limited to Se, but organic photoconductors of PVK (polyvinyl carbazole) type or TNF (trinitrofluorenone) type may also be used for this purpose.

What we claim is:

1. An electrophotographic photosensitive material having an electrically conductive substrate; a photoconductive layer formed on said electrically conductive substrate; and a substantially continuous amorphous silicon layer as a surface protection layer for the photoconductive layer, the thickness of which is so controlled that it has substantially no ability to absorb the light used.

2. An electrophotographic photosensitive material according to claim 1, wherein said amorphous silicon layer has a thickness of 0.01–0.08 μm.

3. An electrophotographic photosensitive material according to claim 1, wherein said photoconductive layer is an inorganic photoconductive layer containing selenium.

4. An electrophotographic photosensitive material according to claim 3, wherein said inorganic photoconductive layer is of a Se-Te system.

5. An electrophotographic photosensitive material having an electrically conductive support; a carrier transportation layer and a carrier generating layer formed on said support; and a substantially continuous amorphous silicon layer which is formed in the outermost part as a surface protection layer, and the thickness of which is, when a light signal is irradiated thereto, such that it has substantially no ability to absorb the light.

6. An electrophotographic photosensitive material according to claim 5, wherein said carrier transportation layer consists of an organic photoconductive material.

7. An electrophotographic photosensitive material according to claim 5, wherein said carrier generating layer is a layer of Se-Te alloy having added thereto a prescribed amount of indium.

8. An electrophotographic photosensitive material according to claim 5, wherein said amorphous silicon layer has a thickness of 0.01–0.08 μm.

9. An electrophotographic photosensitive material according to claim 1, wherein the photoconductive layer includes an amorphous selenium layer and a selenium-tellurium alloy layer.

10. An electrophotographic photosensitive material according to claim 1, further including a barrier layer positioned between the substrate and the photoconductive layer.

11. An electrophotographic photosensitive material according to claim 10, wherein the barrier layer is an arsenic triselenide layer.

12. An electrophotographic photosensitive material according to claim 7, wherein the Se-Te alloy contains about 15% by weight Te.

13. An electrophotographic photosensitive material according to claim 7, wherein said prescribed amount of indium is 0.1–5.0% by weight.

* * * * *